US011408636B2

(12) United States Patent
Li et al.

(10) Patent No.: US 11,408,636 B2
(45) Date of Patent: Aug. 9, 2022

(54) AIR GUIDE GRILLE, AIR INLET PANEL AND AIR CONDITIONER

(71) Applicant: GREE ELECTRIC APPLIANCES, INC. OF ZHUHAI, Zhuhai (CN)

(72) Inventors: Yao Li, Guangdong (CN); Tengju Liu, Guangdong (CN); Zhangcheng Chen, Guangdong (CN); Shanyong Ma, Guangdong (CN)

(73) Assignee: GREE ELECTRIC APPLIANCES, INC. OF ZHUHAI, Zhuhai Guangdong (CN)

( * ) Notice: Subject to any disclaimer, the term of this patent is extended or adjusted under 35 U.S.C. 154(b) by 356 days.

(21) Appl. No.: 16/485,529

(22) PCT Filed: Oct. 16, 2017

(86) PCT No.: PCT/CN2017/106288
§ 371 (c)(1),
(2) Date: Aug. 13, 2019

(87) PCT Pub. No.: WO2018/149163
PCT Pub. Date: Aug. 23, 2018

(65) Prior Publication Data

US 2019/0368772 A1 Dec. 5, 2019

(30) Foreign Application Priority Data

Feb. 17, 2017 (CN) ..... 201710087459.3

(51) Int. Cl.
*F24F 13/08* (2006.01)
*F24F 1/028* (2019.01)
(Continued)

(52) U.S. Cl.
CPC ..... *F24F 13/082* (2013.01); *F24F 1/028* (2019.02); *F24F 13/24* (2013.01); *F24F 1/027* (2013.01)

(58) Field of Classification Search
USPC ..... 454/277
See application file for complete search history.

(56) References Cited

U.S. PATENT DOCUMENTS 3,217,626 A * 11/1965 Sweeney ..... F24F 13/075 454/299
3,402,653 A * 9/1968 Lex ..... F24F 13/08 454/116
(Continued)

FOREIGN PATENT DOCUMENTS

CN 202792294 U 3/2013
CN 104019500 A * 9/2014
(Continued)

OTHER PUBLICATIONS

International Search Report issued in PCT/CN2017/106288, dated Jan. 17, 2018, 2 pages.

*Primary Examiner* — Edelmira Bosques
*Assistant Examiner* — Frances F. Hamilton
(74) *Attorney, Agent, or Firm* — Armstrong Teasdale LLP

(57) ABSTRACT

An air guide grille is provided, the air guide grille includes a plurality of grid strips, wherein the plurality of grid strips are arranged in a plurality of rows, an air inlet side edge of each of the plurality of grid strips is of a corrugated shape, and an air inlet side edges of two adjacent rows of grid strips in the plurality of grid strips is provided in a staggered manner along a length direction of the corrugation. In order to form a corrugated air inlet between two adjacent rows of gate strips, the each of the plurality of grid strips has an air guide surface inclined toward a first direction along the air guiding direction thereof, and the first direction is parallel to
(Continued)

an undulating direction of a corrugation. In addition, an air inlet panel and an air conditioner are also disclosed.

20 Claims, 6 Drawing Sheets

(51) Int. Cl.
*F24F 13/24* (2006.01)
*F24F 1/027* (2019.01)

(56) References Cited

U.S. PATENT DOCUMENTS 3,468,239 A * 9/1969 Straub ..... F24F 13/1486 454/320
4,886,421 A * 12/1989 Danson ..... F03D 3/068 416/236 R
5,052,285 A * 10/1991 Rich ..... F24F 13/072 454/301
5,118,252 A * 6/1992 Chaney ..... F04D 29/703 415/119
7,100,395 B2 * 9/2006 Kim ..... F24F 1/40 62/428
8,960,259 B2 * 2/2015 Weston ..... F24F 13/082 160/290.1
9,249,666 B2 * 2/2016 Wood ..... F03D 1/0633
9,650,828 B1 * 5/2017 Weston ..... E06B 9/24
10,871,172 B2 * 12/2020 Kim ..... F24F 1/38
10,914,319 B2 * 2/2021 Saburi ..... F28F 9/22
2004/0146395 A1 * 7/2004 Uselton ..... F24F 1/56 415/119
2018/0283728 A1 * 10/2018 Li ..... F24F 13/06
2019/0226693 A1 * 7/2019 Dirkskotter ..... F24F 3/14
2020/0292201 A1 * 9/2020 Perkinson ..... F24F 13/24

FOREIGN PATENT DOCUMENTS

CN 104019500 A 9/2014
CN 104048369 A 9/2014
CN 106766055 A 5/2017
CN 206531250 U * 9/2017
CN 206531250 U 9/2017
CN 110332692 A * 10/2019
CN 112524689 A * 3/2021 ..... F24F 13/20
CN 108800505 B * 4/2021 ..... F24F 1/06
FR 2879797 A1 * 6/2006 ..... B60H 1/00514
GB 1312674 A * 4/1973 ..... F24F 13/24
JP 2015048989 A 3/2015
KR 20010026570 A 4/2001

* cited by examiner

AIR GUIDE GRILLE, AIR INLET PANEL AND AIR CONDITIONER

RELATED APPLICATIONS

This application is the national stage entry of PCT/CN2017/106288, filed on Oct. 16, 2017, and entitled "Air Guide Grille, Air Inlet Panel and Air Conditioner," which claims priority to Chinese Patent Application No. 201710087459.3, filed on Feb. 17, 2017, and entitled "Air Guiding Grille, Air Inlet Panel and Air Conditioner," which are hereby incorporated by reference in their entirety.

TECHNICAL FIELD

Some embodiments of the present disclosure relates to an air guide grid. The present disclosure also relates to an air inlet panel and an air conditioner.

BACKGROUND

The air guide grid is a common functional component, and is widely applied at an air inlet and/or an air outlet of, for example, an air conditioning system, an air purifier, a new air system, and various other apparatuses having an air supply function, so as to be used as an air inlet grid and/or an air outlet grille, respectively, so as to direct the passing air flow.

Taking the air inlet grille of the air conditioner as an example, in the prior art, a simple straight grille is adopted, and the flow guiding effect thereof is poor, and the in-machine noise is easily transmitted to the indoor by the grille, and the in-machine structure is easily viewed through the grille, thereby influencing the overall aesthetics of the air conditioner. In particular, for a window-type air conditioner in the prior art, the air inlet grille occupies almost the whole air inlet panel, and a simple and rough structure makes the aesthetic appearance of the window-type air conditioner poor, and it is difficult to match with home supplies in the modern time.

SUMMARY

Based on the above circumstances, some embodiments of the present disclosure provide an air guide grille capable of solving at least one of the above problems.

The above objects are achieved by the following technical solutions: An air guide grille, including a plurality of grid strips arranged in a plurality of rows, an air inlet side edge of each of the plurality of grid strips is of a corrugated shape, and an air inlet side edges of two adjacent rows of grid strips in the plurality of grid strips are provided in a staggered manner along a length direction of a corrugation, so as to form a corrugated air inlet between the two adjacent rows of grid strips, the each of the plurality of grid strips has an air guide surface; the air guiding surface is inclined toward a first direction along an air guiding direction thereof, and the first direction is parallel to an undulating direction of a corrugation.

In an exemplary embodiment, the corrugated shape of the air inlet side edge is a sinusoidal wave shape.

In an exemplary embodiment, sinusoidal wave phases of the air inlet edges of the two adjacent rows of grid strips are opposite.

In an exemplary embodiment, air inlet side edges of all the plurality of grid strips are coplanar.

In an exemplary embodiment, the each of the plurality of grid strips includes a plurality of grille base units with the same specification.

In an exemplary embodiment, an inclination angle of an air guide surface of each of the plurality of grille base units inclined toward the first direction is gradually changed from a center position of a corresponding grille base unit to both sides, wherein the center position corresponds to a valley position of a corrugation.

In an exemplary embodiment, the inclination angle of the center position of the each of the plurality of grille base units is between 60° and 80°.

In an exemplary embodiment, the inclination angle is 70°.

In an exemplary embodiment, a projection of an air outlet side edge of each of the plurality of grille base units along the first direction is of an arc shape.

In an exemplary embodiment, a first rib is provided at a position, close to an air outlet side edge, of a front side of an air guide surface of each of the plurality of grille base units; and/or a second rib is provided at a position, close to an air inlet side edge, of a rear surface side of an air guide surface of each of the plurality of grille base units.

In an exemplary embodiment, a height of the first rib is between 2 mm and 3.5 mm; and/or a height of the second rib is between 0.4 mm and 1.1 mm.

In an exemplary embodiment, the height of the first rib gradually decreases from a central position to both sides, and preferably, a height of the central position of the first rib is 2.5 mm.

Some embodiments of the present disclosure provide an air inlet panel, which is achieved by the following technical solutions:

An air inlet panel is provided, the air inlet panel includes the aforementioned air guide grille.

In an exemplary embodiment, the air guide grille is located at a lower portion of the air inlet panel, such that the first direction faces an upper portion of the air inlet panel.

In an exemplary embodiment, the upper portion of the air inlet panel is provided as a display function region.

Some embodiments of the present disclosure provide an air conditioner, which is realized by the following technical solutions:

an air conditioner including the aforementioned air inlet panel.

In an exemplary embodiment, the air conditioner is a window-type air conditioner, and the air inlet panel is located at an indoor side.

The air guide grille of an embodiment of the present disclosure can effectively guide the air flow flowing through the grille, and meanwhile, the air flow can effectively increase a cross-sectional area of the air flow after the air flow flows out of the air guide grille, and can also effectively block a front gap of the air guide grille, thereby advantageously blocking the transmission of sound and light through the air guide grille. In particular, the air guide grille of an embodiment of the present disclosure has a particularly aesthetically appealing appearance shape, and the water corrugated morphology element is perfectly fused with the air guide grille, so that the overall aesthetics of the corresponding products configuring the air guide grille can be effectively improved.

BRIEF DESCRIPTION OF THE DRAWINGS

Preferred embodiments of the air deflector, the air inlet panel and the air conditioner according to the present disclosure will be described below with reference to the accompanying drawings. In the figures.

DETAILED DESCRIPTION OF THE EMBODIMENTS

According to an embodiment of the present disclosure, an air guide grille 100 is provided, for example, the air guide grille 100 is disposed on an air inlet panel 200 shown in FIGS. 1-4 for use as an air inlet grille. It should be noted that the air guide grille 100 of the present disclosure can also be used as an air outlet guide grille, for example, arranged on a corresponding air outlet panel or at an air outlet of a corresponding device.

Figure 1:
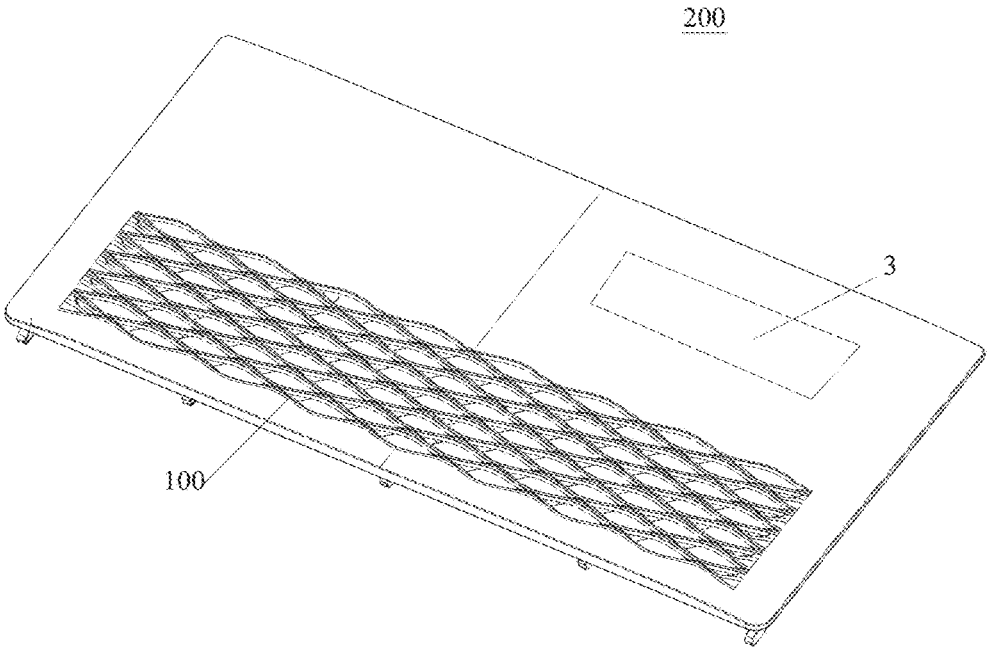
FIG. 1 illustrates a perspective diagram of an air inlet panel according to an embodiment of the present disclosure.
Figure 2:
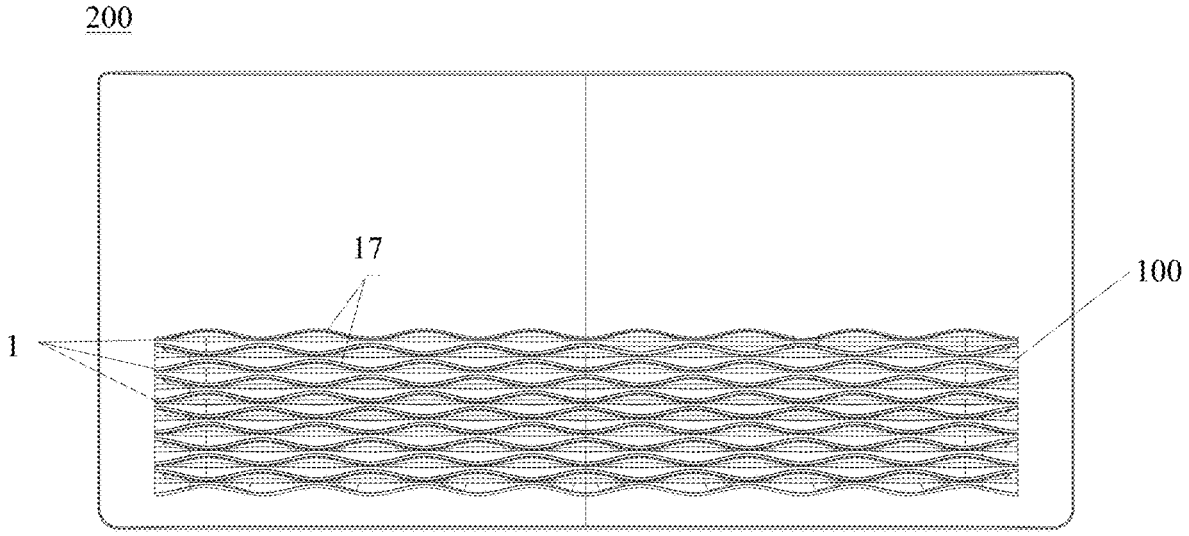
FIG. 2 illustrates a schematic front view of the air inlet panel of FIG. 1.

As shown in FIGS. 1 and 2, the air guide grille 100 of the present disclosure includes a plurality of grid strips 1.

Figure 12:
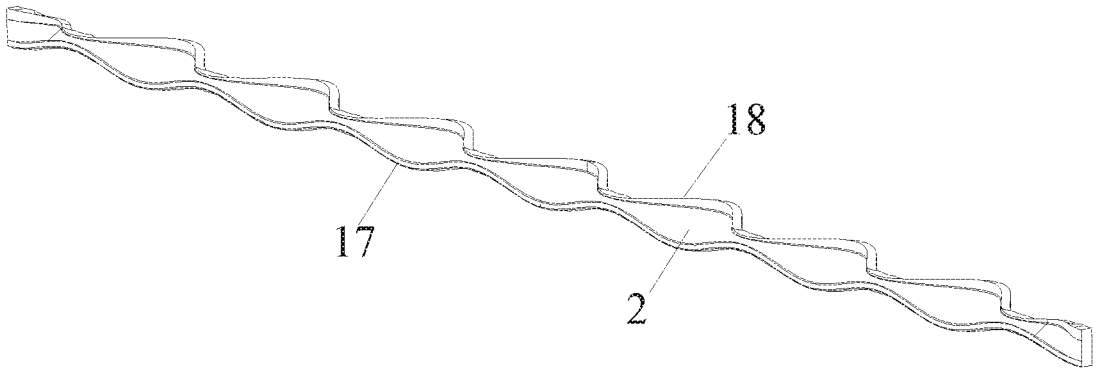
FIG. 12 illustrates a perspective diagram of one grid strip of an air guide grille according to an embodiment of the present disclosure.
Figure 13:
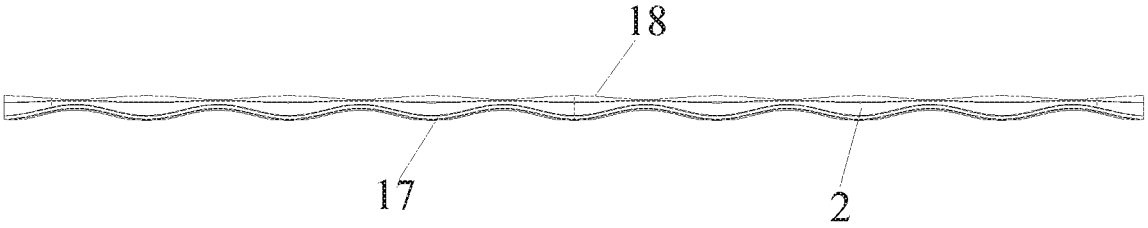
FIG. 13 illustrates a front view of the grid strip of FIG. 12.
Figure 14:
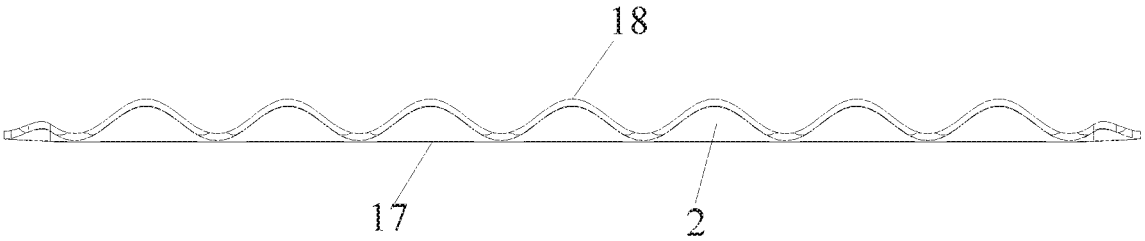
FIG. 14 illustrates a top view of FIG. 13.

A preferred structure of a single grid strip 1 is shown for example in FIGS. 12-14, each of the plurality of grid strips 1 has an air inlet side edge 17 and an air outlet side edge 18. The plurality of grid strips 1 are arranged in a plurality of rows, and when viewed from a front of the air guide grille 100, the air inlet side edge 17 of the each of the plurality of grid strips 1 is of a corrugated shape, for example, may be in a shape similar to a water corrugation, which is represented by a wavy line in FIG. 2. The air inlet side edges 17 of two adjacent rows of the plurality of grid strips 1 are arranged in a staggered manner in a length direction of a corrugation (namely, a length direction of the grid strips 1), so that the peak of the two adjacent rows of corrugations are staggered with each other (the valleys are naturally also staggered with each other), so that gaps between the two adjacent rows of grid strips 1 are continuously changed in the length direction of the grid strips 1, so as to form a corrugated air inlet between the two adjacent rows of grid strips 1.

In addition to the corrugated air inlet side edge 17, each grid strip 1 also has an air guide surface 2 extending from the air inlet side edge 17 of the corresponding grid strip 1 to the air outlet side edge 18, and the air guide surface 2 is inclined toward a first direction along an air guiding direction thereof (namely, a direction from the air inlet side edge 17 to the air outlet side edge 18. that is, the width direction of each grid strip 1), wherein the first direction is parallel to an undulating direction of the corrugation, for example, may be an offset direction parallel to the peak of the corrugation with respect to a balancing position, or may be an offset direction parallel to the valley of the corrugation with respect to the balancing position. For example, when the longitudinal direction of the corrugations (namely, the length direction of the grid strip 1) is a horizontal direction, the air guide surface 2 may be inclined upward (or downward) along the air guide direction thereof. Obviously, the plurality of grid strips 1 are also arranged in a plurality of rows along the first direction.

Then, the above structure enables the air guide grid 100 of the present disclosure to form a 3D corrugated grille, for example, a 3D water corrugated grille.

The 3D corrugated air guide grille of the present disclosure can effectively guide the airflow flowing through the grille, and meanwhile, by means of the inclination of the air guide surface 2, on the one hand, a cross-sectional area of the airflow can be effectively increased after the airflow flows out of the air guide grille 100, and on the other hand, a front gap of the air guide grille 100 can be effectively blocked, so as to prevent sound and light from propagating through the air guide grille. In particular, the 3D corrugated grille of the present disclosure has a particularly aesthetically appealing appearance shape, and the water corrugated morphological element is perfectly fused with the grille, so that the overall aesthetics of the corresponding products configuring the grille of the air guide grille 100 can be effectively improved.

It is easily understood that when the air guide grille 100 of an embodiment of the present disclosure is used as an air inlet grille of a corresponding device, the air inlet side edge 17 of the each grid strip 1 faces an outside of the corresponding device, the air outlet side edge 18 faces an inside of the corresponding device, and the air inlet side edges 17 of all the plurality of grid strips 1 form an outside surface of the air guide grille 100; when the air guiding grille 100 of the present disclosure is used as an air outlet grille of the corresponding device, the air outlet side edge 18 of each grid strip 1 faces the outside of the corresponding device and the air inlet side edge 17 faces the inside of the corresponding device, and the air outlet side edges 18 of all the plurality of grid strips 1 form the outside surface of the air guide grille 100. It can be easily seen that, when used as an air inlet grille, the air guide grille 100 of the present disclosure is more beautiful.

In an exemplary embodiment, the corrugated shape of the air inlet side edge 17 of the grating strip 1 is a sinusoidal wave shape, which in addition to being closer to the water corrugated shape is easy to generate waveform, thereby facilitating the manufacture and molding advantages.

In an exemplary embodiment, as shown in FIG. 2, sinusoidal waves of the air inlet side edges 17 of the two adjacent rows of grid strips 1 are opposite phases, namely, the phase difference is n so that the peaks of the two adjacent rows of grid strips 1 are directly opposite to the valleys, the shape of the corrugated air inlet is the most aesthetic and coordinated, and an area of the air inlet is also the largest.

Figure 3:
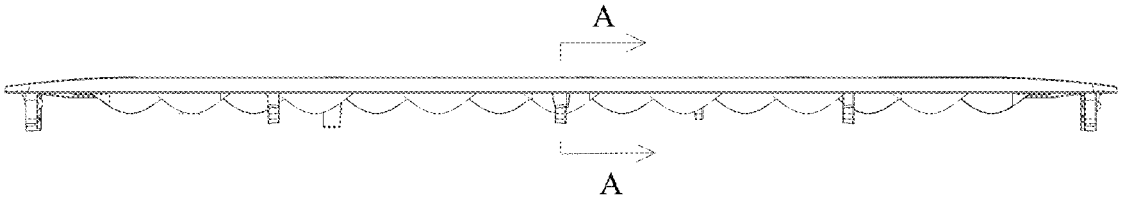
FIG. 3 illustrates a bottom view of FIG. 2.
Figure 4:
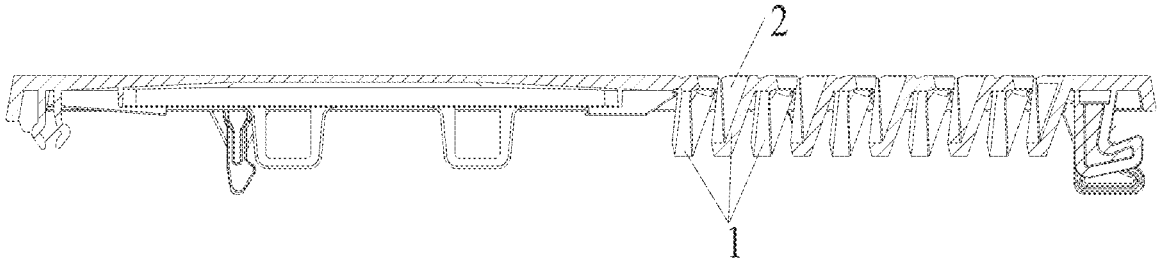
FIG. 4 illustrates a cross-sectional view of A-A in FIG. 3, showing a grille cross-section.

In an exemplary embodiment, air inlet side edges 17 of all the plurality of grid strips 1 are coplanar. Namely, when used as an air inlet grille, an outer side surface of the air guide grille 100 of the present disclosure is located in one plane, and referring to FIGS. 3 and 4, the outer side surface of the air guide grille 100 and an outer surface of the air inlet panel 200 belong to one plane, so as to make an appearance of the air guide grille 100 and the air inlet panel 200 clean. In FIGS. 3 and 4, the air inlet side edge 17 of each grid strip 1 is located at an upper side in the figures, and the air outlet side edge 18 is located at a lower side in the figures.

In addition, it can be seen from FIG. 3 that the air outlet side edges 18 of the each of the plurality of grid strips 1 are not coplanar, but assume another corrugated shape, which can effectively increase an air guiding distance of the air guiding surfaces 2. In addition, as an air inlet grille, the air outlet side edge 18 is hidden inside a corresponding apparatus, and thus does not affect the overall appearance of the apparatus.

In an exemplary embodiment, the each of the plurality of grid strips 1 includes a plurality of grille base units 11 with the same specifications, specifically as shown in FIGS. 5-8 and 12-14. That is, the each of the plurality of grid strips 1 is divided into a plurality of repeated grille base units 11, and each grille base unit 11 is a wavelength of a corrugated shape of the grid strip 1, for example, a length from one valley to the next valley, and a plurality of grille base units 11 are connected to each other to form one grid strip 1. Such a structure enables the structure of the grid strip 1 to have obviously repeated regularity, which contributes to the manufacture of the grid strip 1.

Figure 5:
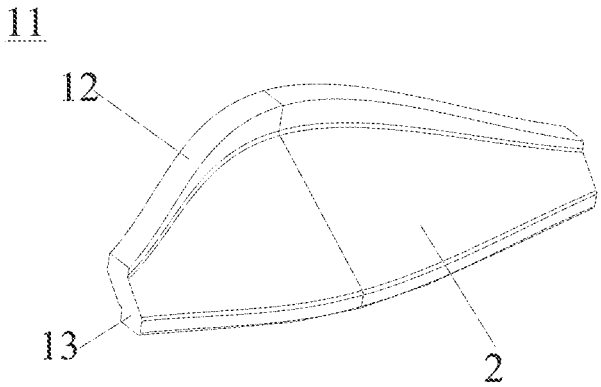
FIG. 5 illustrates a perspective diagram of a grille base unit of an air guide grille according to an embodiment of the present disclosure.
Figure 6:
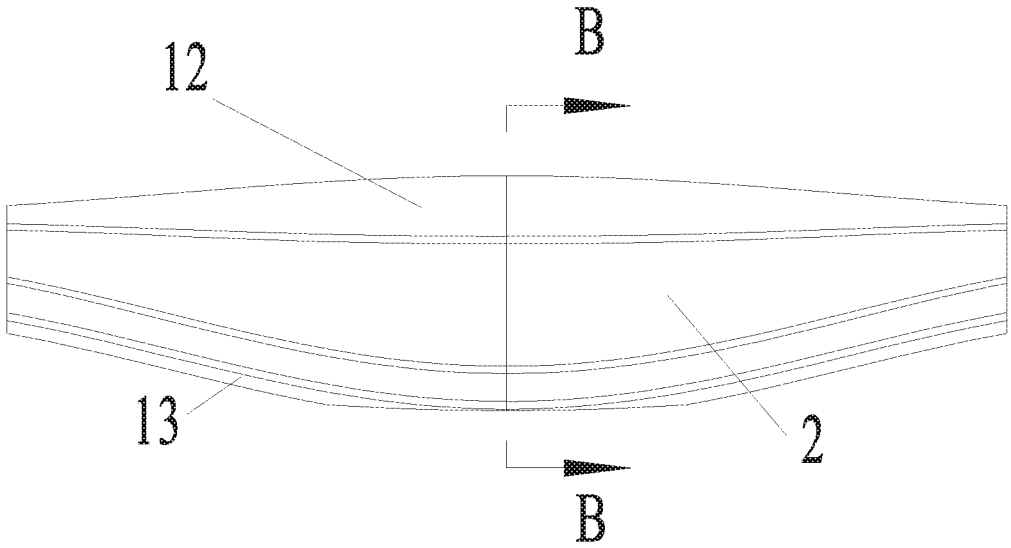
FIG. 6 illustrates a schematic front view of the grille base unit of FIG. 5.
Figure 8:
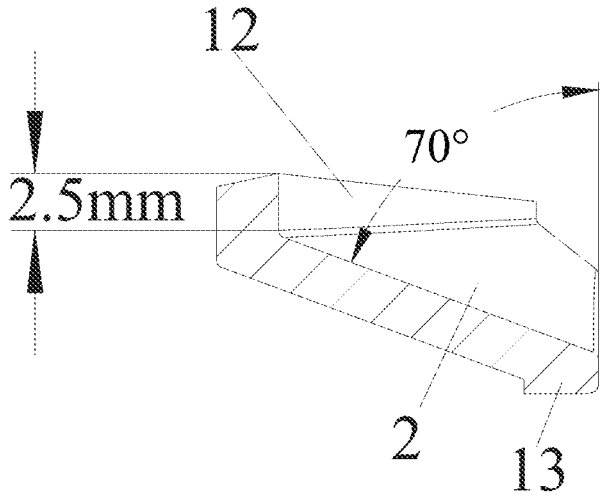
FIG. 8 illustrates a sectional diagram of B-B in FIG. 6.
Figure 9:
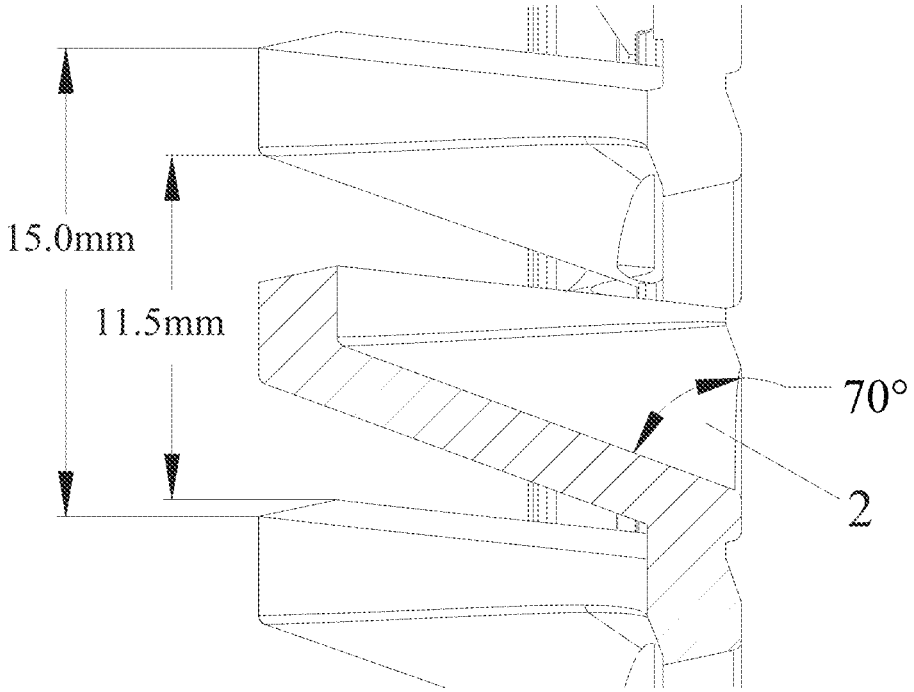
FIG. 9 illustrates a partial enlarged view of the grille section.

As described above, the air guiding surface 2 of the each of the plurality of grid strips 1 is inclined toward a first direction along an air guiding direction thereof, and in an exemplary embodiment, in each of the plurality of grille base units 11, an inclination angle of the air guiding surface 2 inclined toward the first direction is gradually changed from a center position of the corresponding grille base unit 11 to two sides, wherein the center position corresponds to a valley position of a corrugation, that is, the position corresponding to a straight line drawn on the air guiding surface 2 in FIG. 5. As shown in FIGS. 8 and 9, the inclination angle is defined as an included angle between the air guiding surface 2 and a plane where the air inlet side edge 17 is located, that is, an included angle between the air guiding surface 2 and the first direction. When a length direction of the corrugations of the each grid strip 1 (namely, the length direction of the gate strip 1) is a horizontal direction, and when the plane where the air inlet side edge 17 is located is located in a vertical plane, the inclination angle is an included angle between the air guiding surface 2 and a vertical line.

Therefore, the air guiding surface 2 of each grille base unit 11 is a stereoscopic gradual arc surface of a water ripple, so that the air guiding surface 2 does not guide the airflow in a single direction but guides the airflow in different directions of gradual flow, thereby facilitating uniform diffusion of the airflow.

In an exemplary embodiment, the inclination angle of the central position of the grille base unit 11 is 45°. In an exemplary embodiment, is 60°. In an exemplary embodiment, the inclination angle is 70°, as shown in FIGS. 8 and 9. Taking an air inlet grille used as a window-type air conditioner as an example, the magnitude of the inclination angle is related to an windward area of an evaporator and the air inlet volume of the indoor side, the smaller the inclination angle is, the smaller the air inlet volume of the indoor side is, and the larger the inclination angle is, the smaller the windward area of the evaporator is, and further the cooling amount is affected; therefore, the selection of the optimal inclination angle should be determined comprehensively in consideration of the requirements of the air inlet volume and the cooling amount. Meanwhile, the preferable value of the inclination angle can also maximally hide the air inlet, so that an internal structure of the air conditioner is not easily seen from the outside, and the noise in the air conditioner is prevented from propagating to the indoor side.

Figure 7:
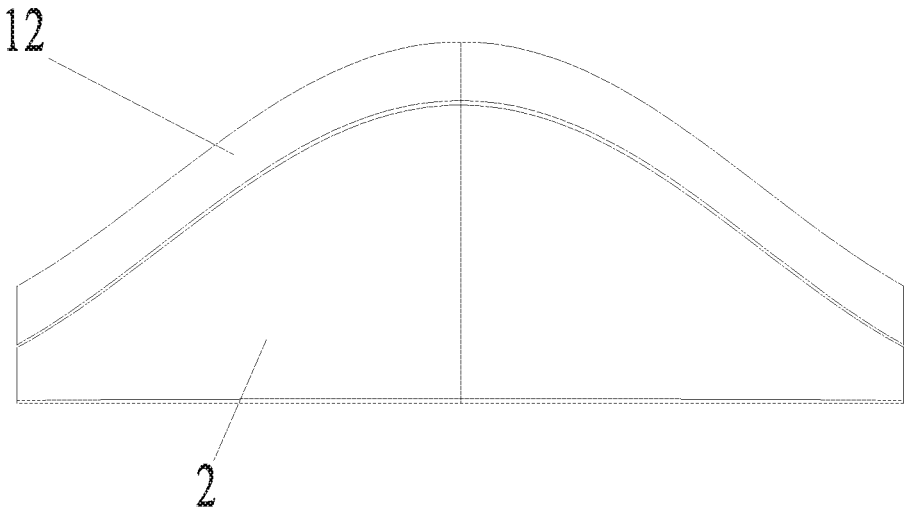
FIG. 7 illustrates a top view of FIG. 6.

In addition, in an exemplary embodiment, it can be easily seen from FIGS. 7 and 8 that the air inlet side edge 17 of the grille base unit 11 is located in a vertical plane, thereby ensuring coplanar characteristics of all the aforementioned air inlet side edges 17 of the grid strips 1.

As a specific structure of the air guide grille 100, as shown in FIG. 9, the separation dimensions of the grille base units 11 with the same phase in the first direction (vertical direction as shown) is determined to be 15 mm according to basic dimensions of the grille base units 11 themselves. The neutral height between the two rows of grid strips 1 with the same phase is 11.5 mm, and the number n of rows of the grille base units 11 superimposed in the first direction is determined by the appearance scheme. The every two rows of grid strips 1 are arranged in a staggered manner in the length direction of the corrugation, thereby enhancing the structural strength of the air guide grille 100, ensuring the grille size of the air guide grille 100, and meanwhile, the corresponding air inlet panel 200 can also be made aesthetically viewed from various directions.

In an exemplary embodiment, as shown in FIG. 3, FIG. 7 and FIG. 14, a projection of an air outlet side edge 18 of each of the plurality of grille base units 11 in the first direction is of arc-shaped, so that the air guiding distance of the air guide surface 2 is gradually changed, and cooperates with the gradually changing form of the inclination angle of the air guiding surface 2, so as to further promote uniform diffusion of the air flow.

In an exemplary embodiment, as shown in FIG. 5, a first rib 12 is provided at a position, close to an air outlet side edge 18, of a front side of the air guide surface 2 of each of the plurality of grille base units 11. In an exemplary embodiment, a protruding direction of the first rib 12 is parallel to the plane where the air inlet side edge 17 is located (for example, an outer surface of the corresponding air inlet panel 200), that is, may protrude toward the first direction. When the air guide grille 100 is arranged in a manner shown in FIG. 9, the protruding direction of the first rib 12 is vertically upward.

In an exemplary embodiment, as shown in FIG. 5, a second rib 13 is provided at a position, close to the air inlet side edge 17, of a rear side of the air guide surface 2 of each of the plurality of grille base units 11. In an exemplary embodiment, a protruding direction of the second rib 13 is parallel to the plane where the air inlet side edge 17 is located (for example, an outer surface of the corresponding air inlet panel 200), that is, the protruding direction may be protruded in an opposite direction of the first direction. When the air guide grille 100 is arranged in a manner shown in FIG. 9, the protruding direction of the second rib 13 is vertically downward.

In an exemplary embodiment, the first rib 12 has a gradually varied extension height, for example, a height of the first rib 12 gradually decreases from a center position to both sides.

The first rib 12 and the second rib 13 function in terms of: (1) the existence of the first rib 12 can further direct the airflow to flow obliquely upwards, and increase the air guiding distance of the air guide grille 100, for example, when used as an air inlet grille of a window-type air conditioner, the windward area of the evaporator can be further increased; (2) both the first rib 12 and the second rib 13 can effectively prevent an inner noise of the air conditioner from transmitting into the indoor side, thereby advantageously affecting the noise experience of the indoor side;

(3) both the first rib 12 and the second rib 13 can effectively hide the air inlet, so as to avoid directly observing the inner part from the indoor side; (4) the second rib 13 can structurally reinforce the strength of the air guide grille 100, so as to avoid distortion deformation or breakage of a surface of the corresponding air inlet panel 200 due to stress; (5) the first rib 12 and the second rib 13 may also serve as a retainer to prevent fingers of children from extending into the interior of the air conditioner, satisfy the requirements of UL test, and prevent other foreign matters from entering the interior of the air guide grille 100 to generate safety hazards.

In an exemplary embodiment, the height of the first rib 12 is between 2 mm and 3.5 mm, and a height of the second rib 13 is between 0.4 mm and 1.1 mm. The height of the first rib 12 is too high to reduce the air inlet area so as to reduce the air inlet volume, and the height is too low to make the gap between the two rows of grid strips too large to have safety hazards; therefore, in both aspects of the overall structure and function, it is determined in an embodiment of the present disclosure that a center height of the first rib 12 is 2.5 mm, as shown in FIG. 8.

Hereinafter, taking the air guide grille of the present disclosure as an indoor air inlet grille of a window-type air conditioner as an example, a process of determining an optimal value of an inclination angle (hereinafter, simply referred to as a central inclination angle) at a center position of the grille base unit 11 and an optimal value of a height (hereinafter, simply referred to as a center height) at a center position of the first rib 12 in the present disclosure will be described in conjunction with experiments.

In the test, three angular values of 60°, 70° and 80° are respectively selected for the central inclination angle, three values of 2 mm, 2.5 mm and 3 mm are selected for the central height, and two values are configured to form nine grilles for indoor air volume testing, and the test results are shown in Table 1.

As can be seen from the test results in Table 1, when the center height of the first rib is 3 mm or the center inclination angle of the grille base unit is 60°, the indoor wind volume is small, for example, both are less than 370 $m^3/h$, and in contrast, the air inlet effect is poor. Moreover, grilles having a central inclination angle of 70° and 80° and a central height of 2 mm and 2.5 mm are more advantageous for the indoor air volume.

For this reason, the refrigeration amount test is further performed with four grilles which are more advantageous for the indoor air volume, and the test results are shown in Table 2.

From the test results in Table 2, it can be seen that the refrigeration amount when the center inclination angle of the grille base unit is 70° is significantly better than the refrigeration amount when the center inclination angle is 80°, and thus 70° is selected as the optimal value. The reason for this is that, when the center inclination angle is 80°, although the air volume becomes large (see FIG. 1), the wind speed is quick, so that the air of the indoor side does not pass through sufficient refrigeration to enter the indoor when passing through the evaporator, thereby causing the refrigeration amount to decrease. In addition, it can be seen from Table 2 that, in the case where the center inclination angle is 70°, since the influence of the center height of the first rib on the refrigeration amount is not great, the optimum value of the center height is selected to be 2.5 mm in order to comprehensively consider the effects of safety factor and front dust prevention and aesthetic appearance.

TABLE 1

Comparative Test Results of Wind Volume

| | Center inclination angle | | |
|---|---|---|---|
| Center hight | 60° | 70° | 80° |
| 2 mm | 369.3 $m^3/h$ | 375.8 $m^3/h$ | 382.5 $m^3/h$ |
| 2.5 mm | 362.8 $m^3/h$ | 372.0 $m^3/h$ | 379.7 $m^3/h$ |
| 3 mm | 357.1 $m^3/h$ | 364.2 $m^3/h$ | 367.4 $m^3/h$ |

TABLE 2

Comparative Test Results of Refrigeration Capacity

| | Center inclination angle | |
|---|---|---|
| Center hight | 70° | 80° |
| 2 mm | 7986.1 Btu/h | 7859.7 Btu/h |
| 2.5 mm | 7972 Btu/h | 7717 Btu/h |

On the basis of the above work, an embodiment of the present disclosure provides an air inlet panel 200, which includes the air guide grille 100 described above in the present disclosure, as shown in FIGS. 1-4.

Figure 10:
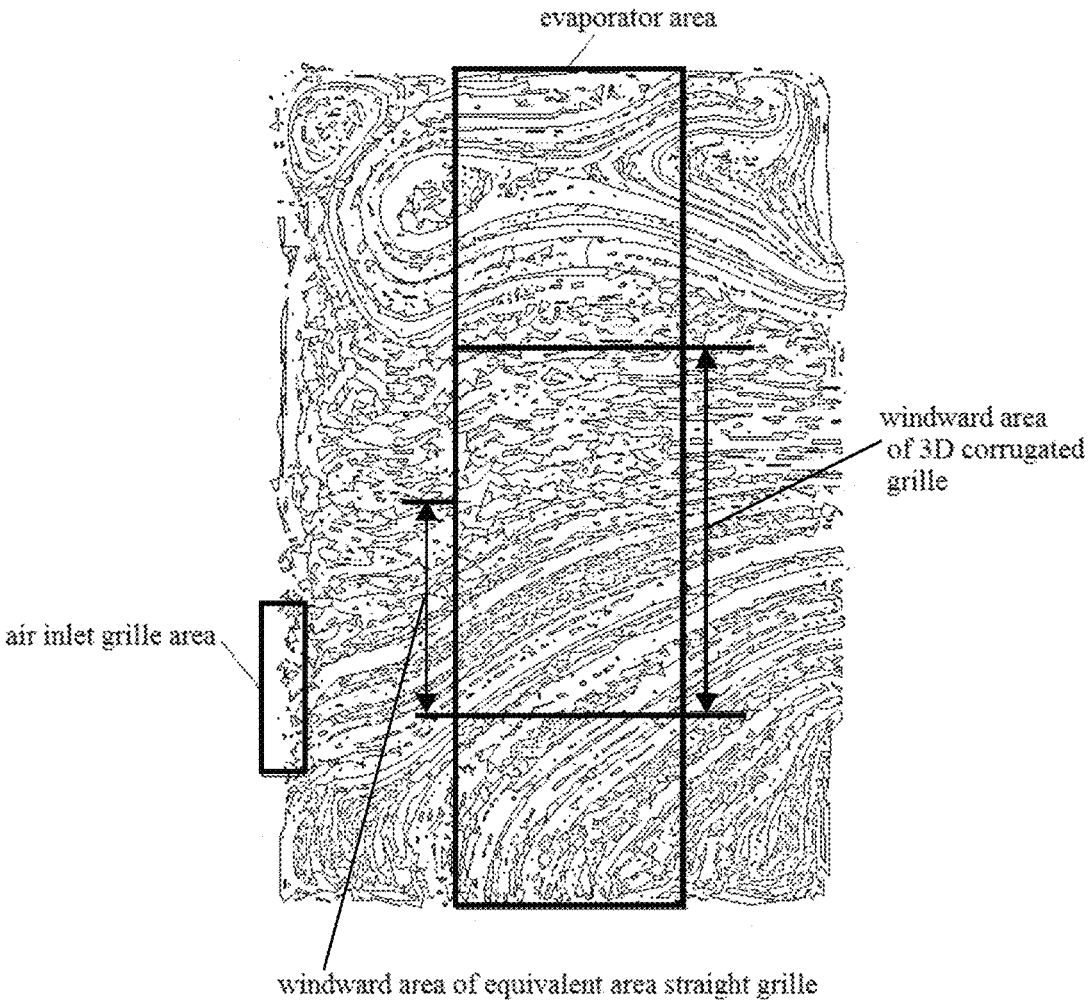
FIG. 10 illustrates a schematic diagram of an air flow path of an air guide grille of the present disclosure.

FIG. 10 is a schematic diagram illustrating an air flow path having an air guide grille 100 of the present disclosure by taking an air inlet panel of a window-type air conditioner as an example. Since the main function of the 3D corrugated structure of the air guide grille 100 in the present disclosure lies in guiding the indoor air inlet, it can be seen from FIG. 10 that the air having a high temperature on indoor side flows obliquely upward by a guiding action of the grille when passing through the air guide grille 100, the air is further lifted by the first rib 12 and then enters the interior of the air conditioner, it can be seen from the flow direction of the air flow path that, compared with the straight grille with the same area in the prior art, the windward area of the evaporator when using the 3D corrugated grille of the present disclosure is significantly increased. Therefore, the same refrigeration capacity requirement can still be guaranteed with appropriate reduction of the grille area.

In an exemplary embodiment, the air guide grille 100 in an embodiment of the present disclosure is located at a lower portion of the air inlet panel 200, and the first direction is directed toward an upper portion of the air inlet panel 200 when the air guiding grille 100 is arranged. In this way, in a case where the area is reduced compared with the straight grille in the prior art, the upper portion of the air inlet panel 200 may be made to leave a large empty area to enrich the function of the air inlet panel 200 and/or improve the appearance of the air inlet panel 200.

In an exemplary embodiment, the upper portion of the air inlet panel 200 is arranged as a display function area, for example, a touch screen display panel may be added, for example, for setting corresponding touch function keys. In an exemplary embodiment, the area of the upper portion ⅔ of the air inlet panel 200 of the present disclosure may be a reserved smooth surface, and an injection-molded light-transmitting display area, a trademark, a touch key icon, and the like may be customized according to the requirement. Compared with the air inlet panel in the prior art, the area of the display area can be significantly increased.

In particular, the air inlet panel 200 of the present disclosure is compared with the air inlet panel in the prior art, because the air inlet of the air guide grille 100 has a smaller opening area relative to the straight grille, and the corrugation shapes of the air inlet area are provided in a stagger manner. The noise generated inside the air inlet panel 200 (such as the noise of the motor, the compressor, or the like inside the air conditioner) can be effectively blocked, thereby improving the noise experience inside the room.

In addition, the panel grille of a conventional window-type air conditioner is easily fouled, and there are a large number of cleaning dead corners, while the graded arc surface of the air guide grille 100 and a curved surface formed by the graded rib of the present disclosure is completely exposed, so that the inside of the panel can be conveniently accessed during scrubbing, and there is no dust dead corner, and the cleaning can be performed at any time after use. Even when used for a long time, the entire panel can be kept in a clean state.

Figure 11:
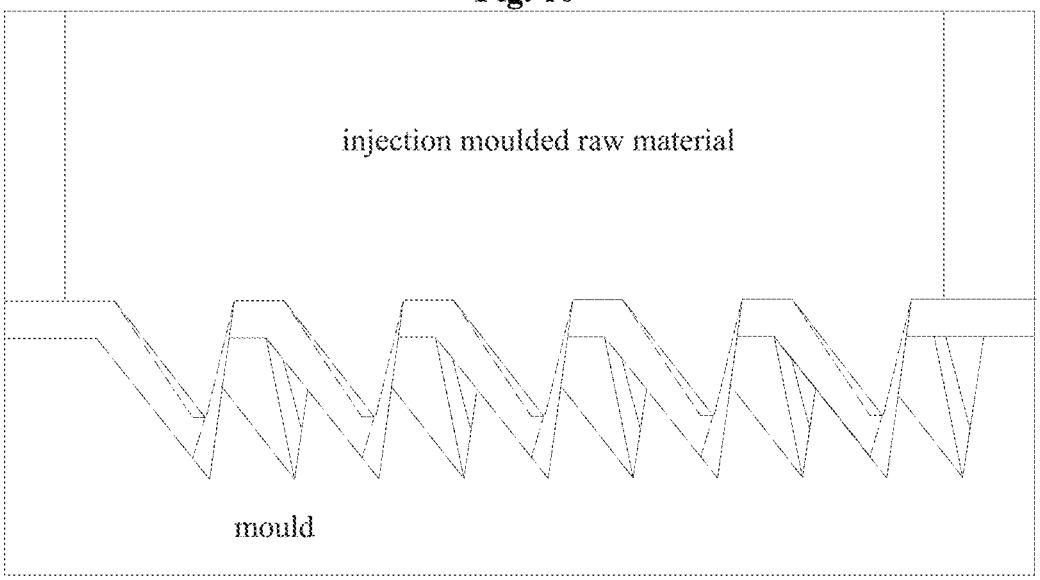
FIG. 11 illustrates a schematic diagram of an injection mould of an air guide grille in the present disclosure.

In addition, in addition to said advantages in terms of structure and function, the air inlet panel 200 of the present disclosure can also protect the injection mould during the production of the air inlet panel 100. Specifically, referring to FIG. 11, in the figure, the solid line portion represents a mold contour when the ribbed structure is not present, and the dotted line portion represents a mold contour when the ribbed structure is present, it can be seen that when the ribbed structure is present, the sharp angle of the mold development can be effectively avoided, thereby effectively extending the life of the mold and reducing the maintenance cost of the mold.

In summary, while increasing the display area, the air inlet panel 200 of an embodiment of the present disclosure can guide the indoor air entering the inside of the window-type air conditioner upwardly, thereby not affecting the windward area of the evaporator, positively influencing the refrigeration effect, and blocking the path of the inner noise of the air conditioner transmitting to the indoor side, and improving the experience of the indoor noise. Meanwhile, the air inlet panel 200 of the present disclosure can change the low-end image of the window-type air conditioner panel, improve the aesthetics of the window-type air conditioner product, and enhance the market competitiveness of the product.

Therefore, on the basis of the above work, the present disclosure further provides an air conditioner, which includes the air inlet panel 200 provided in the front of the present disclosure. In particular, the air conditioner in the present disclosure is a window-type air conditioner, wherein the air inlet panel 200 is located on the indoor side. The window-type air conditioner of some embodiments of the present disclosure changes the simple and rough appearance of the front face of a conventional window-type air conditioner, and helps to lift the shift of the window-type air conditioner, so that the window-type air conditioner has the potential of traveling from a low-end machine to a high-end machine.

It will be readily understood by those skilled in the art that said preferred solutions can be freely combined and superimposed without conflict.

It should be understood that said embodiments are merely exemplary and not restrictive, and that various obvious or equivalent modifications or replacements can be made by those skilled in the art with respect to said details without departing from the basic principles of the present disclosure, all fall within the scope of the claims of the present disclosure.

What is claimed is:

1. An air guide grille, comprising a plurality of grid strips, each grid strip having an air inlet side edge of a corrugated shape, and having an air guide surface inclined toward a first direction along an air guiding direction thereof, the first direction is parallel to an undulant direction of a corrugation; the plurality of grid strips are arranged in a plurality of rows, wherein two adjacent rows of the plurality of grid strips are provided in a staggered manner along a length direction of a corrugation, so as to form a corrugated air inlet between the adjacent rows of grid strips.

2. The air guide grille as claimed in claim 1, wherein the corrugated shape of the air inlet side edge is a sinusoidal wave shape.

3. The air guide grille as claimed in claim 2, wherein sinusoidal wave phases of the air inlet side edges of the two adjacent rows of grid strips are opposite.

4. The air guide grille as claimed in claim 1, wherein air inlet side edges of all the plurality of grid strips are coplanar.

5. The air guide grille as claimed in claim 1, wherein the each of the plurality of grid strips comprises a plurality of grille base units with the same specifications.

6. The air guide grille as claimed in claim 5, wherein an inclination angle of an air guide surface of each of the plurality of grille base units inclined toward the first direction is gradually changed from a center position of a corresponding grille base unit to two sides, wherein the center position corresponds to a valley position of a corrugation.

7. The air guide grille as claimed in claim 6, wherein the inclination angle of the center position of the each of the plurality of grille base units is between 60° and 80°.

8. The air guide grille as claimed in claim 7, wherein the inclination angle is 70°.

9. The air guide grille as claimed in claim 5, wherein along the first direction, a projection of an air outlet side edge of each of the plurality of grille base units is of an arc shape.

10. The air guide grille as claimed in claim 5, wherein a first rib is provided at a position, close to an air outlet side edge, of a front side of an air guide surface of each of the plurality of grille base units; and/or a second rib is provided at a position, close to an air inlet side edge, of a rear surface side of an air guide surface of each of the plurality of grille base units.

11. The air guide grille as claimed in claim 10, wherein a height of the first rib is between 2 mm and 3.5 mm; and/or a height of the second rib is between 0.4 mm and 1.1 mm.

12. The air guide grille as claimed in claim 10, wherein the height of the first rib gradually decreases from a central position to two sides, and preferably, a height of a central position of the first rib is 2.5 mm.

13. An air inlet panel, comprising the air guide grille as claimed in claim 1.

14. The air inlet panel as claimed in claim 13, wherein the air guide grille is located at a lower portion of the air inlet panel such that the first direction faces an upper portion of the air inlet panel.

15. The air inlet panel as claimed in claim 14, wherein the upper portion of the air inlet panel is provided as a display function region.

16. An air conditioner, comprising the air inlet panel as claimed in claim 13.

17. The air conditioner as claimed in claim 16, wherein the air conditioner is a window-type air conditioner, and the air inlet panel is located at an indoor side.

18. The air inlet panel as claimed in claim 13, wherein the corrugated shape of the air inlet side edge is a sinusoidal wave shape.

19. The air inlet panel as claimed in claim 13, wherein sinusoidal wave phases of the air inlet side edges of the two adjacent rows of grid strips are opposite.

20. The air inlet panel as claimed in claim 13, wherein air inlet side edges of all the plurality of grid strips are coplanar.

* * * * *